US009812770B2

(12) United States Patent
Gavilan et al.

(10) Patent No.: US 9,812,770 B2
(45) Date of Patent: Nov. 7, 2017

(54) ANTENNA INTEGRATED WITH METAL CHASSIS

(71) Applicant: Nvidia Corporation, Santa Clara, CA (US)

(72) Inventors: Joselito Gavilan, Santa Clara, CA (US); Warren Lee, Santa Clara, CA (US)

(73) Assignee: Nvidia Corporation, Santa Clara, CA (US)

( * ) Notice: Subject to any disclaimer, the term of this patent is extended or adjusted under 35 U.S.C. 154(b) by 236 days.

(21) Appl. No.: 13/711,951

(22) Filed: Dec. 12, 2012

(65) Prior Publication Data

US 2014/0118204 A1 May 1, 2014

Related U.S. Application Data

(60) Provisional application No. 61/721,358, filed on Nov. 1, 2012.

(51) Int. Cl.

| | |
|---|---|
| ***H01Q 9/00*** | (2006.01) |
| ***H01Q 1/50*** | (2006.01) |
| ***H01Q 1/24*** | (2006.01) |
| ***H01Q 9/42*** | (2006.01) |
| ***H01Q 5/371*** | (2015.01) |
| ***H01Q 5/378*** | (2015.01) |

(52) U.S. Cl.

CPC ..... *H01Q 1/50* (2013.01); *H01Q 1/243* (2013.01); *H01Q 5/371* (2015.01); *H01Q 5/378* (2015.01); *H01Q 9/42* (2013.01)

(58) Field of Classification Search

CPC ..... H01Q 9/00; H01Q 1/38; H01Q 1/24
USPC ..... 343/754, 700 MS, 702
See application file for complete search history.

(56) References Cited

U.S. PATENT DOCUMENTS

| | | | | |
|---|---|---|---|---|
| 4,125,810 | A * | 11/1978 | Pavio | 455/327 |
| 5,861,854 | A | 1/1999 | Kawahata et al. | |
| 6,229,487 | B1 | 5/2001 | Sadler et al. | |
| 6,476,769 | B1 | 11/2002 | Lehtola | |
| 6,911,940 | B2 | 6/2005 | Poilasne et al. | |
| 7,091,908 | B2 | 8/2006 | Fabrega-Sanchez | |
| 7,362,286 | B2 | 4/2008 | Fang | |
| 7,551,142 | B1 | 6/2009 | Zhang et al. | |
| 7,696,928 | B2 | 4/2010 | Rowell | |
| 8,421,682 | B2 | 4/2013 | Nielsen et al. | |
| 8,648,752 | B2 * | 2/2014 | Ramachandran | H01Q 1/24 343/700 MS |
| 8,665,164 | B2 * | 3/2014 | Hill | H01Q 1/243 343/702 |
| 8,698,673 | B2 | 4/2014 | Wong et al. | |
| 8,766,859 | B2 | 7/2014 | Merz et al. | |

(Continued)

FOREIGN PATENT DOCUMENTS

| | | |
|---|---|---|
| CN | 101106211 A | 1/2008 |
| CN | 101442151 A | 5/2009 |

(Continued)

*Primary Examiner* — Huedung Mancuso

(57) ABSTRACT

One aspect provides an antenna. The antenna, in this aspect, includes a grounded segment extending from a metal chassis of an electronic device, and a feed portion coplanar with the grounded segment, the grounded segment and feed portion jointly tuned to cause the antenna to communicate in selected bands of frequencies.

18 Claims, 4 Drawing Sheets

(56) References Cited

U.S. PATENT DOCUMENTS

| | | | | |
|---|---|---|---|---|
| 8,779,999 | B2 * | 7/2014 | Gummalla | G06F 1/1656 343/702 |
| 8,836,587 | B2 | 9/2014 | Darnell et al. | |
| 8,957,827 | B1 * | 2/2015 | Lee | H01Q 5/321 343/700 MS |
| 2002/0146909 | A1 | 10/2002 | Yang et al. | |
| 2004/0252061 | A1 | 12/2004 | Vance | |
| 2006/0082506 | A1 | 4/2006 | Fang | |
| 2006/0139211 | A1 * | 6/2006 | Vance | H01Q 9/0421 343/700 MS |
| 2006/0208950 | A1 | 9/2006 | Tago | |
| 2007/0182658 | A1 | 8/2007 | Ozden | |
| 2008/0106478 | A1 * | 5/2008 | Hill | 343/702 |
| 2008/0231521 | A1 | 9/2008 | Anguera Pros et al. | |
| 2010/0033380 | A1 | 2/2010 | Pascolini et al. | |
| 2010/0271264 | A1 | 10/2010 | Li et al. | |
| 2010/0321255 | A1 * | 12/2010 | Kough | H01Q 1/2266 343/702 |
| 2011/0001675 | A1 | 1/2011 | Lee | |
| 2011/0260938 | A1 | 10/2011 | Xie | |
| 2012/0046002 | A1 * | 2/2012 | Hill | H01Q 1/243 455/73 |
| 2012/0154223 | A1 * | 6/2012 | Oh et al. | 343/702 |
| 2012/0173754 | A1 * | 7/2012 | Dalrymple | H04L 65/1096 709/231 |
| 2012/0214412 | A1 | 8/2012 | Schlub et al. | |
| 2012/0249393 | A1 * | 10/2012 | Hotta et al. | 343/843 |
| 2012/0299785 | A1 * | 11/2012 | Bevelacqua | H01Q 9/42 343/702 |
| 2013/0050057 | A1 * | 2/2013 | Hayashi et al. | 343/893 |
| 2013/0069836 | A1 | 3/2013 | Bungo | |
| 2013/0135156 | A1 * | 5/2013 | Tsai | H01Q 5/371 343/702 |
| 2013/0222186 | A1 | 8/2013 | Leung et al. | |
| 2014/0118194 | A1 | 5/2014 | Gavilan et al. | |
| 2014/0141731 | A1 | 5/2014 | Abudul-Gaffoor et al. | |
| 2014/0159989 | A1 | 6/2014 | Malek et al. | |
| 2014/0232612 | A1 | 8/2014 | Jenwatanavet | |
| 2014/0266938 | A1 | 9/2014 | Ouyang et al. | |
| 2014/0368398 | A1 | 12/2014 | Ying | |
| 2015/0015445 | A1 | 1/2015 | Sanchez | |
| 2015/0022401 | A1 | 1/2015 | Gavilan et al. | |
| 2015/0022402 | A1 | 1/2015 | Gavilan et al. | |
| 2015/0207219 | A1 | 7/2015 | Oh et al. | |
| 2015/0207228 | A1 | 7/2015 | Oh et al. | |
| 2015/0207230 | A1 | 7/2015 | Oh et al. | |
| 2015/0207231 | A1 | 7/2015 | Oh et al. | |

FOREIGN PATENT DOCUMENTS

| | | | |
|---|---|---|---|
| CN | 201927704 | A | 8/2011 |
| DE | 69723366 | T2 | 4/2004 |
| DE | 102013017512 | A1 | 5/2014 |
| EP | 2405533 | A1 | 1/2012 |
| TW | 201101591 | A | 1/2011 |

* cited by examiner

ANTENNA INTEGRATED WITH METAL CHASSIS

CROSS-REFERENCE TO RELATED APPLICATION

This application claims the benefit of U.S. Provisional Application Ser. No. 61/721,358, filed by Joselito Gavilan, et al., on Nov. 1, 2012, entitled "Antennas Integrated with Metal Housings," commonly assigned with this application and incorporated herein by reference.

TECHNICAL FIELD

This application is directed, in general, to antennas and, more specifically, to antennas for electronic devices.

BACKGROUND

Handheld electronic devices are becoming increasingly popular. Examples of handheld devices include handheld computers, cellular telephones, media players, and hybrid devices that include the functionality of multiple devices of this type.

Due in part to their mobile nature, handheld electronic devices are often provided with wireless communications capabilities. Handheld electronic devices may use long-range wireless communications to communicate with wireless base stations. For example, cellular telephones may communicate using 2G Global System for Mobile Communication (commonly referred to as GSM) frequency bands at about 850 MHz, 900 MHz, 1800 MHz, and 1900 MHz, among possible others. Communication is also possible in the 3G Universal Mobile Telecommunication System (commonly referred to as UMTS) and 4G Long Term Evolution (commonly referred to as LTE) frequency bands which range from 700 MHz to 3800 MHz. Furthermore, communication can operate on channels with variable bandwidths of 1.4 MHz to 20 MHz for LTE, as opposed to the fixed bandwidths of GSM (0.2 MHz) and UMTS (5 MHz). Handheld electronic devices may also use short-range wireless communications links. For example, handheld electronic devices may communicate using the Wi-Fi® (IEEE 802.11) bands at about 2.4 GHz and 5 GHz, and the Bluetooth® band at about 2.4 GHz. Handheld devices with Global Positioning System (GPS) capabilities receive GPS signals at about 1575 MHz.

To satisfy consumer demand for small form factor wireless devices, manufacturers are continually striving to reduce the size of components that are used in these devices. For example, manufacturers have made attempts to miniaturize the antennas used in handheld electronic devices. Unfortunately, doing so within the confines of the wireless device package is challenging.

Accordingly, what is needed in the art is an antenna, and associated wireless handheld electronic device that navigates the desires and problems associated with the foregoing.

SUMMARY

One aspect provides an antenna. The antenna, in this aspect, includes a grounded segment extending from a metal chassis of an electronic device, and a feed portion coplanar with the grounded segment, the grounded segment and feed portion jointly tuned to cause the antenna to communicate in selected bands of frequencies.

Another aspect provides an electronic device. The electronic device, in this aspect, includes: 1) a metal chassis, 2) storage and processing circuitry positioned within the metal chassis, 3) input-output devices associated with the storage and processing circuitry and positioned within the metal chassis, and 4) wireless communications circuitry including an antenna. The antenna, in this aspect, includes a grounded segment extending from the metal chassis, and a feed portion coplanar with the grounded segment, the grounded segment and feed portion jointly tuned to cause the antenna to communicate in selected bands of frequencies.

BRIEF DESCRIPTION

Reference is now made to the following descriptions taken in conjunction with the accompanying drawings, in which.

DETAILED DESCRIPTION

The present disclosure is based, at least in part, on the recognition that as smartphones and tablets continue to evolve, the manufacturers of such devices (e.g., in order to differentiate their products) are pushing the edge of industrial design in terms of size and thickness. It is further recognized that these same manufacturers are pushing the edge of industrial design through the use of more aesthetically appealing materials, including glass and metal.

The present disclosure has recognized, along with the industry, that the use of a metal chassis creates a challenge for antenna designers since the metal degrades the radiated performance. Accordingly, the typical antenna design strategy for consumer electronic devices is to maximize the volume (air space) where the antenna is located by clearing metal components as far away from the antenna as possible. The reason for this approach is because any metal near the antenna creates a ground plane that reduces the antenna bandwidth. In addition, since the antennas are unbalanced, the currents from the antenna feed can directly or indirectly couple onto the metal chassis in the antenna area, and create an undesired parasitic resonance. With these problems in mind, the general trend in the industry is to create as much space as possible (e.g., within the industrial design requirements of the electronics device) between the antenna feed portion and the metal chassis.

The present disclosure acknowledges, however, that opposed to isolating the antenna feed portion from the metal chassis, as the industry at this time would, the relative positions of the antenna feed portion and the metal chassis should be embraced. For example, the present disclosure acknowledges that the antenna feed portion and the metal chassis can be jointly tuned to cause the antenna to communicate in selected bands of frequencies. Moreover, the present disclosure acknowledges that by extending a grounded segment from the metal chassis of an electronic device, and positioning that grounded segment relative to a feed portion, that the grounded segment and feed portion may be jointly tuned to cause the antenna to communicate in selected bands of frequencies. This tuning of the metal chassis (including the grounded segment extending there from) with the antenna feed portion is a stark departure from the current mindset of present day antenna design.

Figure 1A:
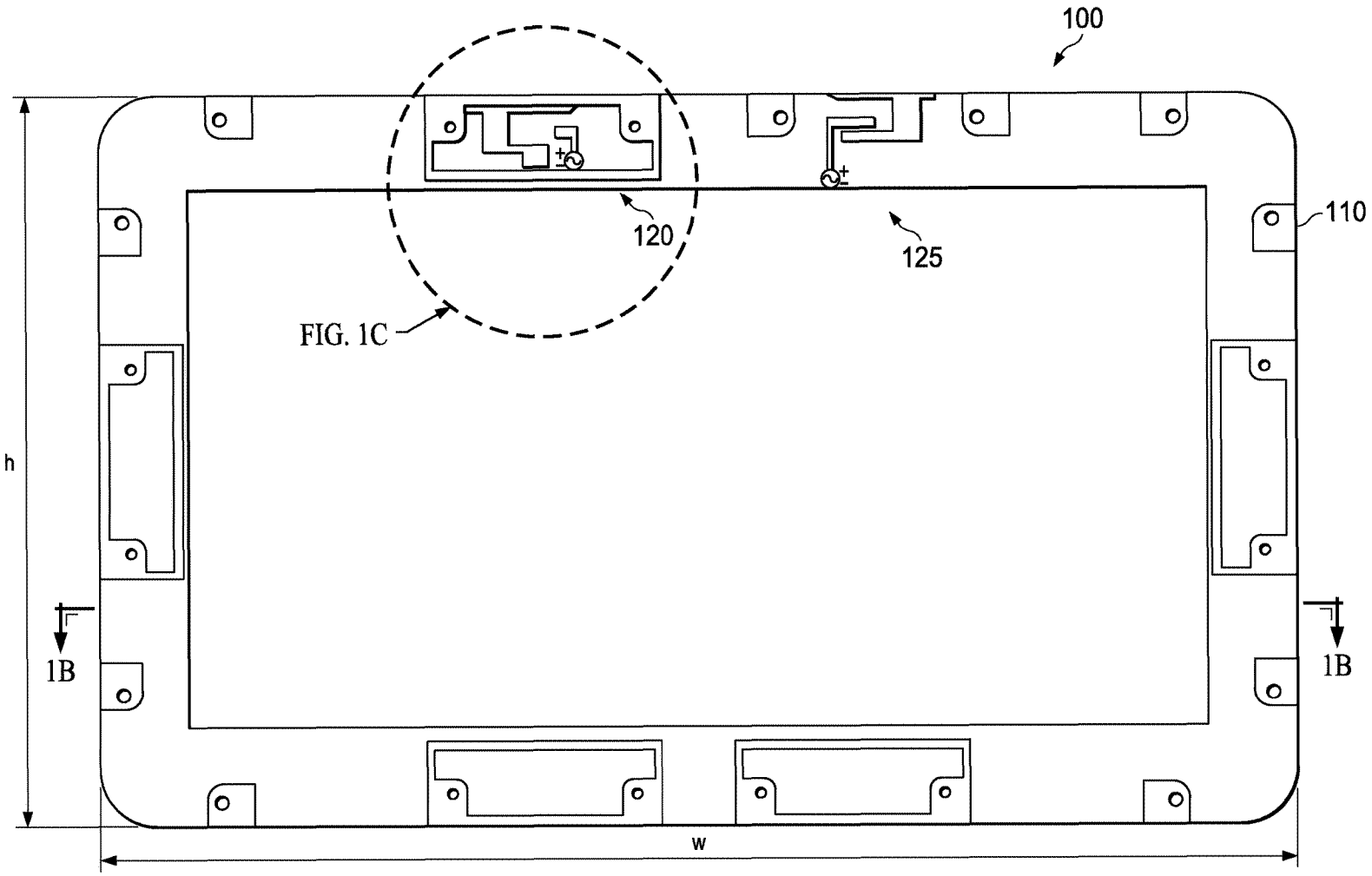
FIGS. 1A-1C illustrates aspects of a representative embodiment of an electronic device in accordance with embodiments of the disclosure.
Figure 1B:
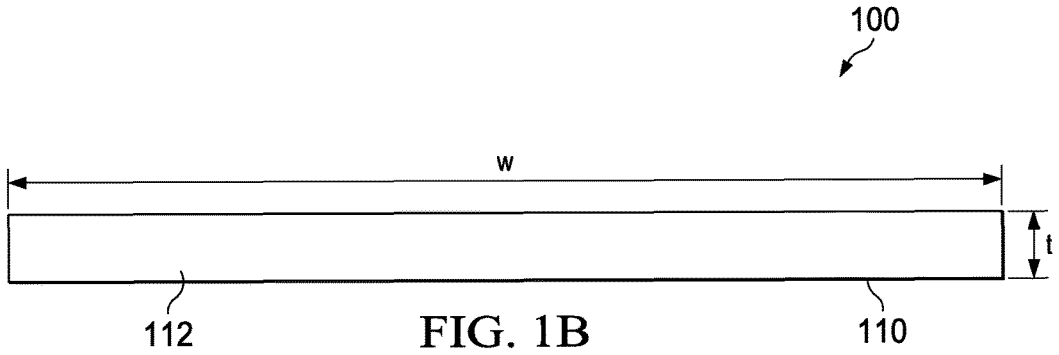
Figure 1C:
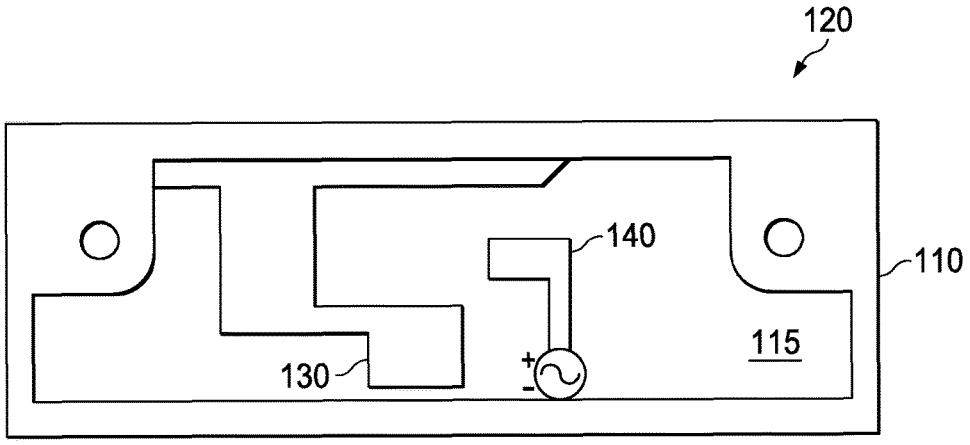

FIGS. 1A-1C illustrates aspects of a representative embodiment of an electronic device 100 in accordance with embodiments of the disclosure. Specifically, FIG. 1A illustrates a top view of the electronic device 100. FIG. 1B illustrates a cross-sectional view of the electronic device 100 taken through the line B-B of FIG. 1A. FIG. 1C illustrates an exploded view of the area C of FIG. 1A.

The electronic device 100 of FIGS. 1A-1C initially includes a metal chassis 110. The term "metal chassis", as used herein, refers to that portion of the electronic device 100 configured to mount/support electronic components such as a battery, printed circuit boards containing integrated circuits and other electrical devices, communications circuitry, a display, etc. The metal chassis 110, in accordance with this disclosure, may comprise a variety of different metals. In one embodiment, the metal chassis 110 comprises aluminum. In another embodiment, the metal chassis 110 comprises steel. In yet another embodiment, the metal chassis 110 comprises an alloy of two or more different metals.

The metal chassis 110 typically includes a width (w), and height (h) and a thickness (t). Those skilled in the art understand that the width (w), height (h) and thickness (t), may vary greatly with the general desires of the manufacturer. Nevertheless, as discussed above, there is often a desire to reduce such dimensions, thereby setting up the problem that the instant disclosure is designed to accommodate. In the illustrated embodiment, the width (w) and height (h) define a first plane, for example a plane that would be consistent with a plane of a display that might be used in the electronic device 100. Furthermore, the thickness (t) and the width (w), as well as the thickness (t) and the height (h), define two other planes, which are consistent with edges 112 of the electronic device 100. The first plane, and two other planes, are generally substantially perpendicular to one another.

The metal chassis 110, in accordance with one embodiment, comprises a continuous metal chassis. In this embodiment, the metal chassis 110 would not include any breaks in the chassis that separate major elements thereof. For example, the metal chassis 110, in this embodiment, would not include a break in the edge 112 of the metal chassis 110. In other embodiments, the metal chassis 110 does not comprise a continuous metal chassis.

The electronic device 100 in accordance with the disclosure further includes one or more antennas 120, 125. In the illustrated embodiment, the electronic device 100 includes two antennas 120, 125. The antennas 120, 125 illustrated in FIG. 1A each include substantially identical features, but the features therein are tuned differently such that each of the antennas operated in different selected bands of frequencies.

As is illustrated in FIG. 1C, the antenna 120 includes a grounded segment 130. The term "segment", as used herein with respect to the antenna, means a conductive feature having an open end. A loop antenna would not be considered a segment in accordance with this definition. The antenna additionally includes a feed portion 140, which in the embodiment of FIGS. 1A-1C is illustrated as a feed segment. Certain embodiments may exist, however, wherein the feed portion 140 is not a segment as defined herein.

The grounded segment 130 and the feed portion 140, in accordance with the disclosure, are jointly tuned to cause the antenna 120 to communicate in selected bands of frequencies. The grounded segment 130, in accordance with the disclosure extends from the metal chassis 110. In certain embodiments, the grounded segment 130 is formed as a part of the metal chassis 110. For example, this might be the case wherein the metal chassis 110 is integrally formed to include the grounded segment 130. In another embodiment, the grounded segment 130 may be electrically attached to the metal chassis 110. This might be the situation wherein the metal chassis 110 is an existing structure, and the grounded segment 130 is subsequently attached thereto. In either situation, the grounded segment 130 extends from the metal chassis 110.

The feed portion 140, in this embodiment, may be that portion of the antenna 120 that first receives radio frequency signals from one or more associated transceivers in the electronic device 100. For example, the feed portion 140 might directly couple to a positive terminal of a transmission line (not shown), such as a coaxial cable, microstrip, etc., to receive radio frequency signals from associated transceivers, and provide them to the other portions of the antenna 120. The feed portion 140 may additionally receive radio frequency signals from the other portions of the antenna 120, and thus provide them to the associated transceivers. The feed portion 140, in accordance with one embodiment of the disclosure, is coplanar with the grounded segment 130. Accordingly, the feed portion 140 and the grounded segment 130 are located in a same plane in this embodiment, a plane that is parallel with a plane created by the width (w) and height (t) of the chassis 110. Other embodiments may exist wherein the feed portion 140 and the ground segment 130 are not coplanar.

In the illustrated embodiment of FIGS. 1A-1C, the metal chassis 110 includes a window 115 located therein. The window 115 might be consistent with an existing design feature of the metal chassis 110. In other embodiments, the window 115 is particularly designed to be part of the antenna 120. In the illustrated embodiment, the grounded segment 130 extends into the window 115 in the metal chassis 110. Further to this embodiment, the feed portion 140 extends into the window 115 proximate the grounded segment 130. While the antenna 120 includes the window 115, the antenna 125 does not. Again, this is a function of tuning the antennas 120, 125 for a particular band of frequencies.

Further to the embodiment of FIGS. 1A-1C, the grounded segment 130 extends from the edge 112 of the metal chassis 110. Other embodiments may exist, however, wherein the ground segment 130 extends from another portion of the metal chassis 110, including a portion of the metal chassis 110 that is located in a plane parallel with the first plane created by the width (w) and height (h).

In the embodiment of FIG. 1C, the feed portion 140 and the ground segment 130 do not overlap one another. Those skilled in the art understand that the degree of overlap, or lack thereof, is part of the joint tuning of the feed portion 140 and ground segment 130 that occurs in the manufacture of the antenna 120, and more specifically in the desire to manufacture an antenna 120 that communicates in a specific band of frequencies. In contrast, the feed portion 140 and ground segment 130 of the antenna 125 do overlap.

Figure 2:
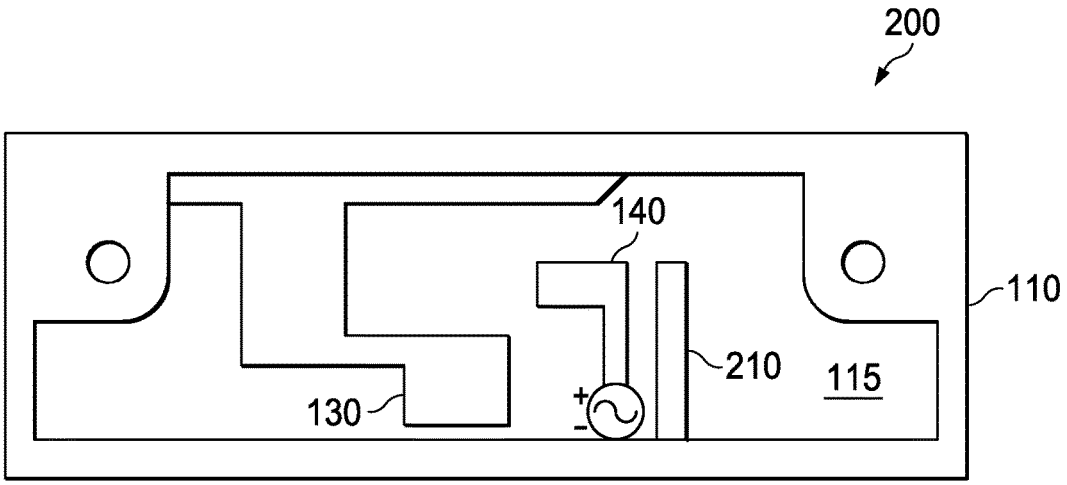
FIG. 2 illustrates an alternative design for an antenna in accordance with the disclosure.

Turning to FIG. 2, illustrated is an alternative design for an antenna 200 in accordance with the disclosure. The antenna 200 includes many of the same features as the antenna 120 illustrated with regard to FIGS. 1A-1C. Accordingly, like reference numerals may be used to reference like features.

In the embodiment of FIG. 2, the antenna 200 includes a parasitic grounded portion 210 routed adjacent to the feed portion 140. The parasitic grounded portion 210, in the embodiment shown is a parasitic grounded segment. Other embodiments may exist, however, wherein the parasitic grounded portion is not a segment as that term is defined herein. The parasitic grounded portion 210 is configurable to induce an additional resonance in a specific band of frequencies. Those skilled in the art understand that the length of the parasitic grounded portion 210 can be tuned to adjust the frequency and bandwidth of the additional resonance. The parasitic grounded portion 210, in the illustrated embodiment, extends from the metal chassis 110. In certain embodiments, the parasitic grounded portion 210 is formed as a part of the metal chassis 110. For example, this might be the case wherein the metal chassis 110 is integrally formed to include the parasitic grounded portion 210. In another embodiment, the parasitic grounded portion 210 may be electrically attached to the metal chassis 110. This might be the situation wherein the metal chassis 110 is an existing structure, and the parasitic grounded portion 150 is subsequently attached thereto. In either situation, the parasitic grounded portion 210 extends from the metal chassis 110.

Figure 3:
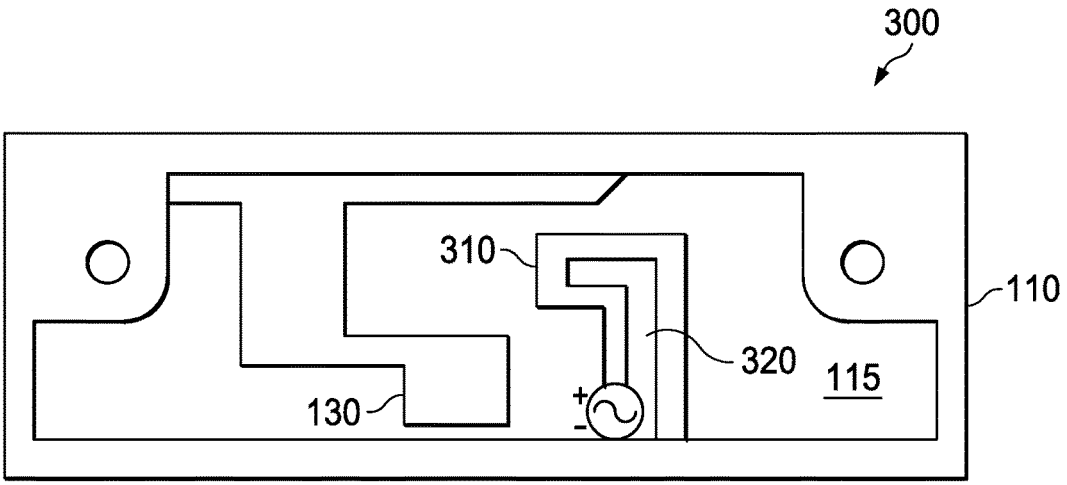
FIG. 3 illustrates yet another alternative design for an antenna in accordance with the disclosure.

Turning to FIG. 3, illustrated is an alternative design for an antenna 300 in accordance with the disclosure. The antenna 300 includes many of the same features as the antenna 120 illustrated with regard to FIGS. 1A-1C. Accordingly, like reference numerals may be used to reference like features.

In the embodiment of FIG. 3, a feed portion 310 of the antenna 300 may extend and fold back to create a slot 320. In this embodiment, the slot 320 creates an additional resonance in a specific band of frequencies controlled by the dimensions of the slot. Those skilled in the art of antenna design, if given the foregoing disclosures, would be readily able to manufacture the device of FIG. 3.

An electronic device, as well as antenna design, in accordance with the disclosure employs the metal chassis as part of the antenna. In one situation, the metal chassis creates an additional loop mode resonance in which the resonant frequency is controlled by configuring the parameters of the metal loop. This can be accomplished, in one embodiment, by coupling the grounded segment (e.g., parasitic) to the metal chassis, and by controlling the size of the grounded segment. The feed portion (e.g., radiating element) may then be tightly coupled by the ground segment. This induces multiple resonance loops in the frequency response. By controlling the parameters of the geometry of the ground segment and feed portion, the designer can move the resonance loops to favorable areas in the Smith chart. Moreover, the designer can use a matching network to achieve the desired response and performance. Moreover, the electronic device and associated antenna may be manufactured without adding slots or breaks in the metal chassis, and without compromising the antenna performance.

Figure 4:
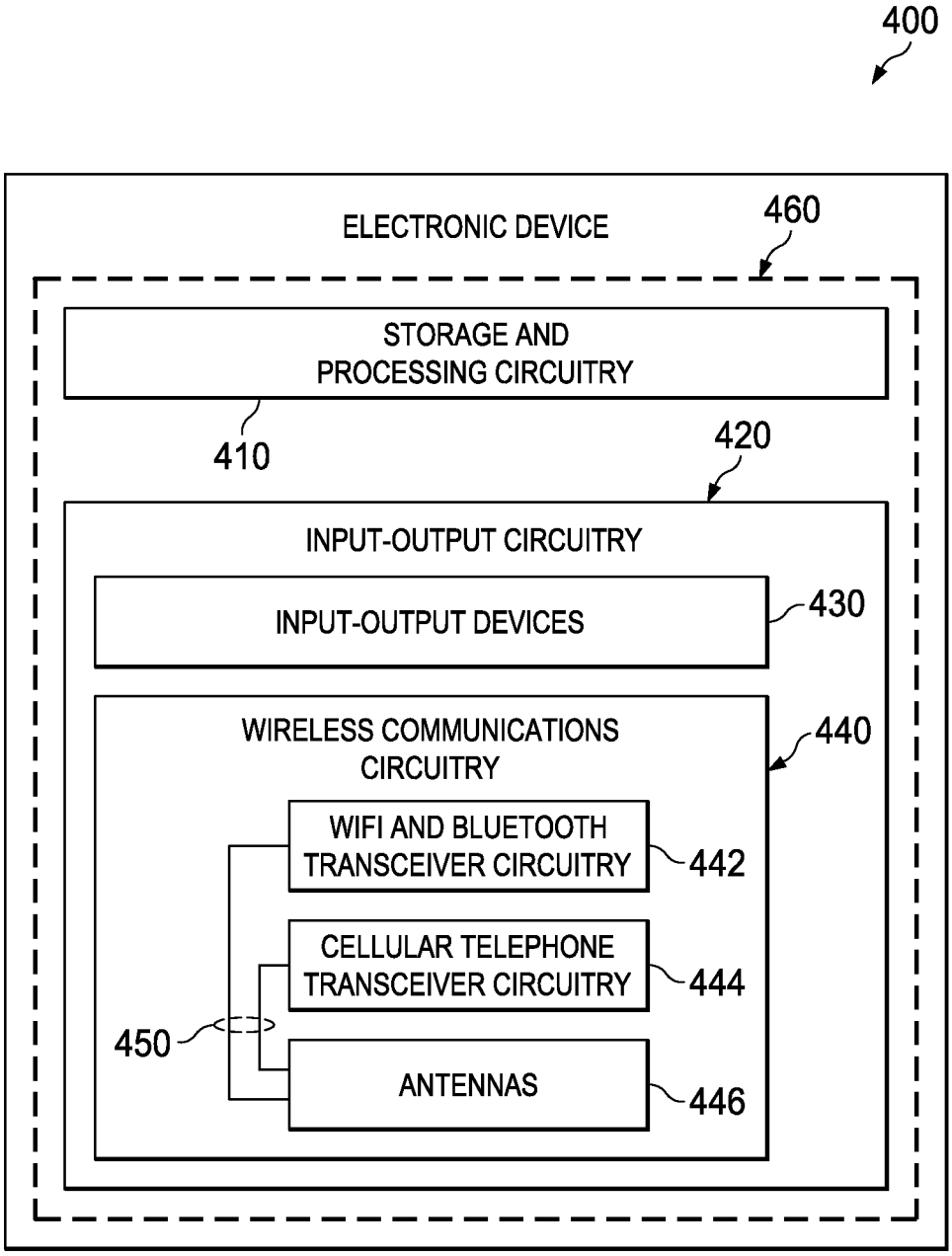
FIG. 4 illustrates a schematic diagram of electronic device manufactured in accordance with the disclosure.

FIG. 4 shows a schematic diagram of electronic device 400 manufactured in accordance with the disclosure. Electronic device 400 may be a portable device such as a mobile telephone, a mobile telephone with media player capabilities, a handheld computer, a remote control, a game player, a global positioning system (GPS) device, a laptop computer, a tablet computer, an ultraportable computer, a combination of such devices, or any other suitable portable electronic device.

As shown in FIG. 4, electronic device 400 may include storage and processing circuitry 410. Storage and processing circuitry 410 may include one or more different types of storage such as hard disk drive storage, nonvolatile memory (e.g., flash memory or other electrically-programmable-read-only memory), volatile memory (e.g., static or dynamic random-access-memory), etc. Processing circuitry in storage and processing circuitry 410 may be used to control the operation of device 400. Processing circuitry may be based on a processor such as a microprocessor and other suitable integrated circuits. With one suitable arrangement, storage and processing circuitry 410 may be used to run software on device 400, such as internet browsing applications, voice-over-internet-protocol (VOIP) telephone call applications, email applications, media playback applications, operating system functions, etc. Storage and processing circuitry 410 may be used in implementing suitable communications protocols.

Communications protocols that may be implemented using storage and processing circuitry 410 include, without limitation, internet protocols, wireless local area network protocols (e.g., IEEE 802.11 protocols—sometimes referred to as WiFi®), protocols for other short-range wireless communications links such as the Bluetooth® protocol, protocols for handling 3 G communications services (e.g., using wide band code division multiple access techniques), 2G cellular telephone communications protocols, etc. Storage and processing circuitry 410 may implement protocols to communicate using cellular telephone bands at 850 MHz, 900 MHz, 1800 MHz, and 1900 MHz (e.g., the main Global System for Mobile Communications or GSM cellular telephone bands) and may implement protocols for handling 3G and 4 G communications services.

Input-output device circuitry 420 may be used to allow data to be supplied to device 400 and to allow data to be provided from device 400 to external devices. Input-output devices 430 such as touch screens and other user input interfaces are examples of input-output circuitry 420. Input-output devices 430 may also include user input-output devices such as buttons, joysticks, click wheels, scrolling wheels, touch pads, key pads, keyboards, microphones, cameras, etc. A user can control the operation of device 400 by supplying commands through such user input devices. Display and audio devices may be included in devices 430 such as liquid-crystal display (LCD) screens, light-emitting diodes (LEDs), organic light-emitting diodes (OLEDs), and other components that present visual information and status data. Display and audio components in input-output devices 430 may also include audio equipment such as speakers and other devices for creating sound. If desired, input-output devices 430 may contain audio-video interface equipment such as jacks and other connectors for external headphones and monitors.

Wireless communications circuitry 440 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications). Wireless communications circuitry 440 may include radio-frequency transceiver circuits for handling multiple radio-frequency communications bands. For example, circuitry 440 may include transceiver circuitry 442 that handles 2.4 GHz and 5 GHz bands for WiFi® (IEEE 802.11) communications and the 2.4 GHz Bluetooth® communications band. Circuitry 440 may also include cellular telephone transceiver circuitry 444 for handling wireless communications in cellular telephone bands such as the GSM bands at 850 MHz, 900 MHz, 1800 MHz, and 1900 MHz, as well as the UMTS and LTE bands (as examples). Wireless communications circuitry 440 can include circuitry for other short-range and long-range wireless links if desired. For example, wireless communications circuitry 440 may include global positioning system (GPS) receiver equipment, wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 440 may include one or more antennas 446. Device 400 may be provided with any suitable number of antennas. There may be, for example, one antenna, two antennas, three antennas, or more than three antennas, in device 400. At least one of the antennas 446 in the device 400, in one embodiment, is similar to the antennas illustrated and described with regard to FIGS. 1A-1C above. In accordance with that discussed above, the antennas may handle communications over multiple communications bands. If desired, a dual band antenna may be used to cover two bands (e.g., 2.4 GHz and 5 GHz). Different types of antennas may be used for different bands and combinations of bands. For example, it may be desirable to form an antenna for forming a local wireless link antenna, an antenna for handling cellular telephone communications bands, and a single band antenna for forming a global positioning system antenna (as examples).

Paths 450, such as transmission line paths, may be used to convey radio-frequency signals between transceivers 442 and 444, and antenna 446. Radio-frequency transceivers such as radio-frequency transceivers 442 and 444 may be implemented using one or more integrated circuits and associated components (e.g., power amplifiers, switching circuits, matching network components such as discrete inductors, capacitors, and resistors, and integrated circuit filter networks, etc.). These devices may be mounted on any suitable mounting structures. With one suitable arrangement, transceiver integrated circuits may be mounted on a printed circuit board. Paths 450 may be used to interconnect the transceiver integrated circuits and other components on the printed circuit board with antenna structures in device 400. Paths 450 may include any suitable conductive pathways over which radio-frequency signals may be conveyed including transmission line path structures such as coaxial cables, microstrip transmission lines, etc.

The device 400 of FIG. 4 further includes a metal chassis 460. The metal chassis 460 may be used for mounting/supporting electronic components such as a battery, printed circuit boards containing integrated circuits and other electrical devices, etc. For example, in one embodiment, the metal chassis 460 positions and supports the storage and processing circuitry 410, and the input-output circuitry 420, including the input-output devices 430 and the wireless communications circuitry 440 (e.g., including the WIFI and Bluetooth transceiver circuitry 442, the cellular telephone circuitry 444, and the antennas 446.

The metal chassis 460 may be made of various different metals, such as aluminum. The metal chassis 460 may be machined or cast out of a single piece of material, such as aluminum. Other methods, however, may additionally be used to form the metal chassis 460. As discussed with regard to FIGS. 1A-1C above, a grounded segment of the antenna 446 extends from the metal chassis 460. In certain embodiments, the grounded segment is formed from the metal chassis 460 (e.g., by way of machining, stamping or casting), and in other embodiments the grounded segment is attached to the metal chassis 460. It is the grounded segment that extends from the metal chassis 460, along with the feed portion of the antenna 446, which are jointly tuned to communicate in selected bands of frequencies.

Those skilled in the art to which this application relates will appreciate that other and further additions, deletions, substitutions and modifications may be made to the described embodiments.

What is claimed is:

1. An antenna, comprising:

a grounded segment extending from a metal chassis of an electronic device, wherein the metal chassis includes one or more bands of conductive material bounding its height and width near a side edge thereof, and further wherein at least one of the bands of conductive material includes a window located therein, and further wherein the grounded segment extends into the window; and a feed portion coplanar with the grounded segment, the grounded segment and feed portion jointly tuned to cause the antenna to communicate in selected bands of frequencies.

2. The antenna recited in claim 1, wherein the feed portion further extends into the window proximate the grounded segment.

3. The antenna recited in claim 2, wherein a plane created by the feed portion and ground segment is substantially parallel to a plane created by a display of the electronic device.

4. The antenna recited in claim 1 wherein the grounded segment is formed from the metal chassis.

5. The antenna recited in claim 1, wherein the grounded segment is attached to the metal chassis.

6. The antenna recited in claim 1, wherein metal chassis includes the side edge that is substantially perpendicular to a plane created by a display of the electronic device, and further wherein the grounded segment extends from the side edge of the metal chassis.

7. The antenna recited in claim 1, wherein the metal chassis is a continuous metal chassis.

8. The antenna recited in claim 1, further including a parasitic grounded portion routed adjacent to the feed portion to cause the antenna to radiate in an additional band of frequencies.

9. The antenna recited in claim 1, wherein the feed portion is extended and folded back to create a slot to cause the antenna to radiate in an additional band of frequencies.

10. The antenna recited in claim 1, wherein the grounded segment, feed portion and selected band of frequencies are a first grounded segment, a first feed portion, and a first selected band of frequencies, and further including:

a second grounded segment extending from the metal chassis of the electronic device; and a second feed portion coplanar with the second grounded segment, the second grounded segment and second feed portion jointly tuned to cause the antenna to communicate in a second different selected bands of frequencies.

11. An electronic device, comprising:

a metal chassis having one or more bands of conductive material bounding its height and width near a side edge thereof;

storage and processing circuitry positioned within the metal chassis;

input-output devices associated with the storage and processing circuitry and positioned within the metal chassis; and wireless communications circuitry including an antenna, the antenna including;

a grounded segment extending from the metal chassis, wherein the metal chassis includes a window located in at least one of the one or more bands of conductive material bounding its height and width, and further wherein the grounded segment extends into the window; and a feed portion coplanar with the grounded segment, the grounded segment and feed portion jointly tuned to cause the antenna to communicate in selected bands of frequencies.

12. The electronic device recited in claim 11, wherein the feed portion further extends into the window proximate the grounded segment.

13. The electronic device recited in claim 12, wherein the input-output device includes a display, and further wherein a plane created by the feed portion and ground segment is substantially parallel to a plane created by the display.

14. The electronic device recited in claim 11, wherein the input-output device includes a display, and further wherein metal chassis includes the side edge that is substantially perpendicular to a plane created by the display, the grounded segment extending from the side edge of the metal chassis.

15. The electronic device recited in claim 11, wherein the metal chassis is a continuous metal chassis.

16. The electronic device recited in claim 11, further including a parasitic grounded portion routed adjacent to the feed portion to cause the antenna to radiate in an additional band of frequencies.

17. The electronic device recited in claim 11, wherein the feed portion is extended and folded back to create a slot to cause the antenna to radiate in an additional band of frequencies.

18. The electronic device recited in claim 11, wherein the grounded segment, feed portion and selected band of frequencies are a first grounded segment, a first feed portion, and a first selected band of frequencies, and further including:

a second grounded segment extending from the metal chassis of the electronic device; and a second feed portion coplanar with the second grounded segment, the second grounded segment and second feed portion jointly tuned to cause the antenna to communicate in a second different selected bands of frequencies.

* * * * *